US009567807B2

(12) United States Patent
Green et al.

(10) Patent No.: US 9,567,807 B2
(45) Date of Patent: Feb. 14, 2017

(54) DIAMOND IMPREGNATED CUTTING STRUCTURES, EARTH-BORING DRILL BITS AND OTHER TOOLS INCLUDING DIAMOND IMPREGNATED CUTTING STRUCTURES, AND RELATED METHODS

(75) Inventors: James C. Green, Spring, TX (US); Ben L. Kirkpatrick, Tyler, TX (US); Christopher J. Cleboski, Houston, TX (US); Nicholas J. Lyons, Houston, TX (US); Andrew R. Warner, Littleton, CO (US); Wesley Dean Fuller, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 574 days.

(21) Appl. No.: 13/253,676

(22) Filed: Oct. 5, 2011

(65) Prior Publication Data

US 2012/0080240 A1 Apr. 5, 2012

Related U.S. Application Data

(60) Provisional application No. 61/390,020, filed on Oct. 5, 2010.

(51) Int. Cl.
*E21B 10/36* (2006.01)
*B24D 18/00* (2006.01)
(Continued)

(52) U.S. Cl.
CPC ..... *E21B 10/573* (2013.01); *B24D 99/005* (2013.01); *E21B 10/43* (2013.01); *E21B 10/46* (2013.01)

(58) Field of Classification Search
CPC ..... E21B 10/46; E21B 10/567; E21B 10/573; E21B 10/43; B24D 99/005
(Continued)

(56) References Cited

U.S. PATENT DOCUMENTS 4,471,845 A * 9/1984 Jurgens ..... 175/431
4,889,017 A * 12/1989 Fuller et al. ..... 76/108.2
(Continued)

OTHER PUBLICATIONS

International Preliminary Report on Patentability for International Application No. PCT/US2011/054949 dated Apr. 9, 2013.
(Continued)

*Primary Examiner* — Nicole Coy
(74) *Attorney, Agent, or Firm* — TraskBritt

(57) ABSTRACT

An earth-boring tool includes a bit body, a plurality of first cutting elements, and a plurality of second cutting elements. Each of the first cutting elements includes a discontinuous phase dispersed within a continuous matrix phase. The discontinuous phase includes a plurality of particles of superabrasive material. Each of the second cutting elements includes a polycrystalline diamond compact or tungsten carbide. A method of forming an earth-boring tool includes disposing a plurality of first cutting elements on a bit body and disposing a second plurality of second cutting elements on the bit body. Another method of foaming an earth-boring tool includes forming a body having a plurality of first cutting elements and a plurality of cutting element pockets and securing each of a plurality of second cutting elements within each of the cutting element pockets.

22 Claims, 7 Drawing Sheets

(51) Int. Cl.

| | |
|---|---|
| ***B24D 3/04*** | (2006.01) |
| ***E21B 10/573*** | (2006.01) |
| ***E21B 10/46*** | (2006.01) |
| ***B24D 99/00*** | (2010.01) |
| ***E21B 10/43*** | (2006.01) |

(58) Field of Classification Search
USPC ..... 175/434, 431, 426, 420.2
See application file for complete search history.

(56) References Cited

U.S. PATENT DOCUMENTS

| | | | |
|---|---|---|---|
| 4,991,670 | A | 2/1991 | Fuller et al. |
| 5,205,684 | A | 4/1993 | Meskin et al. |
| 5,558,170 | A | 9/1996 | Thigpen et al. |
| 6,009,962 | A | 1/2000 | Beaton et al. |
| 6,095,265 | A | 8/2000 | Alsup et al. |
| 6,241,036 | B1 | 6/2001 | Lovato et al. |
| 6,394,202 | B2 | 5/2002 | Truax et al. |
| 6,510,906 | B1 | 1/2003 | Richert et al. |
| 6,725,953 | B2 | 4/2004 | Truax et al. |
| 6,843,333 | B2 | 1/2005 | Richert et al. |
| 7,096,978 | B2 | 8/2006 | Dykstra et al. |
| 7,234,550 | B2 | 6/2007 | Azar et al. |
| 7,350,599 | B2 | 4/2008 | Lockwood et al. |
| 7,469,757 | B2 | 12/2008 | Azar et al. |
| 7,472,764 | B2 | 1/2009 | Zahradnik et al. |
| 7,497,280 | B2 | 3/2009 | Brackin et al. |
| 7,617,747 | B2 | 11/2009 | Richert et al. |
| 7,621,350 | B2 | 11/2009 | Richert |
| 7,776,256 | B2 | 8/2010 | Smith et al. |
| 7,802,495 | B2 | 9/2010 | Oxford et al. |
| 7,810,588 | B2 | 10/2010 | McClain et al. |
| 8,191,657 | B2 | 6/2012 | Richert et al. |
| 8,220,567 | B2 | 7/2012 | Scott et al. |
| 8,225,890 | B2 | 7/2012 | Scott |
| 8,505,634 | B2 | 8/2013 | Lyons et al. |
| 8,794,356 | B2 | 8/2014 | Lyons et al. |
| 2004/0154840 | A1 | 8/2004 | Azar et al. |
| 2007/0158115 | A1 | 7/2007 | Sherwood et al. |
| 2007/0215390 | A1 | 9/2007 | Azar et al. |
| 2009/0084608 | A1 | 4/2009 | McClain et al. |
| 2009/0107732 | A1* | 4/2009 | McClain et al. ..... 175/398 |
| 2010/0122853 | A1 | 5/2010 | Scott et al. |
| 2010/0187011 | A1 | 7/2010 | Jurica et al. |
| 2010/0219000 | A1 | 9/2010 | Doster |
| 2011/0061943 | A1 | 3/2011 | Richert |
| 2011/0155472 | A1 | 6/2011 | Lyons et al. |

OTHER PUBLICATIONS

International Search Report for International Application No. PCT/US2011/054949 dated Apr. 10, 2012, 3 pages.

International Written Opinion for International Application No. PCT/US2011/054949 dated Apr. 10, 2012, 4 pages.

* cited by examiner

DIAMOND IMPREGNATED CUTTING STRUCTURES, EARTH-BORING DRILL BITS AND OTHER TOOLS INCLUDING DIAMOND IMPREGNATED CUTTING STRUCTURES, AND RELATED METHODS

CROSS-REFERENCE TO RELATED APPLICATION

This application claims the benefit of U.S. Provisional Patent Application Ser. No. 61/390,020, filed Oct. 5, 2010, titled "Diamond Impregnated Cutting Structures, Earth-Boring Drill Bits and Other Tools Including Diamond Impregnated Cutting Structures, and Related Methods," the disclosure of which is incorporated herein in its entirety by this reference.

FIELD

Embodiments of the present invention generally relate to earth-boring tools, such as rotary drill bits, that include cutting structures that are impregnated with diamond particles, and to methods of manufacturing such earth-boring tools cutting structures.

BACKGROUND

Impregnated diamond earth-boring rotary drill bits and other tools may be used for drilling hard or abrasive rock formations such as sandstones. Typically, an impregnated diamond bit has a solid head or crown that is cast in a mold. The crown is attached to a steel shank that has a threaded end that may be used to attach the crown and steel shank to a drill string. The crown may have a variety of configurations and generally includes a cutting face comprising a plurality of cutting structures, which may comprise at least one of cutting segments, posts, and blades. The posts and blades may be integrally formed with the crown in the mold, or they may be separately formed and attached to the crown. Channels separate the posts and blades to allow drilling fluid to flow over the face of the bit.

Impregnated diamond bits may be formed such that the cutting face of the drill bit (including the posts and blades) comprises a particle-matrix composite material that includes diamond particles dispersed throughout a matrix material. The matrix material itself may comprise a particle-matrix composite material, such as particles of tungsten carbide, dispersed throughout a metal matrix material, such as a copper-based alloy.

While drilling with an impregnated diamond bit, the matrix material surrounding the diamond particles wears at a faster rate than do the diamond particles. As the matrix material surrounding the diamonds on the surface of the bit wears away, the exposure of the diamonds at the surface gradually increases until the diamonds eventually fall away. As some diamonds are falling away, others that were previously buried become exposed, such that fresh, sharp diamonds are continuously being exposed and used to cut the earth formation.

Typically, an impregnated diamond bit is formed by mixing and distributing diamond particles and other hard particles, such as particles of tungsten carbide, in a mold cavity having a shape corresponding to the bit to be formed. The diamond particles and hard particles are then infiltrated with a molten metal matrix material, such as a copper-based metal alloy. After infiltration, the molten metal matrix material is allowed to cool and solidify. The resulting impregnated diamond bit may then be removed from the mold. Alternatively, a mixture of diamond particles, hard particles, and powder matrix material may be pressed and sintered in a hot isostatic pressing (HIP) process to form diamond-impregnated blades, posts, or other segments, which may be brazed or otherwise attached to a separately formed bit body.

BRIEF SUMMARY

An earth-boring tool includes a bit body, a plurality of first cutting elements, and a plurality of second cutting elements. Each of the first cutting elements includes a discontinuous phase dispersed within a continuous matrix phase. The discontinuous phase includes a plurality of particles of superabrasive material. Each of the second cutting elements includes at least one of a polycrystalline diamond compact and tungsten carbide.

A method of forming an earth-boring tool includes disposing a plurality of first cutting elements on a bit body and disposing a plurality of second cutting elements on the bit body. Each cutting element of the plurality of first cutting elements comprising a first discontinuous phase comprising a plurality of particles of superabrasive material dispersed within a continuous matrix phase. Each cutting element of the plurality of second cutting elements comprises at least one of a polycrystalline diamond compact and tungsten carbide.

A method of forming an earth-boring tool includes forming a body having a plurality of first cutting elements and a plurality of cutting element pockets, and securing each of a plurality of second cutting elements within each of the cutting element pockets. Each first cutting element includes a discontinuous phase having a plurality of particles of superabrasive material dispersed within a continuous matrix phase. Each cutting element of the second plurality includes at least one of a polycrystalline diamond compact and tungsten carbide.

BRIEF DESCRIPTION OF THE DRAWINGS

While the specification concludes with claims particularly pointing out and distinctly claiming what are regarded as embodiments of the disclosure, the advantages of this disclosure may be more readily ascertained from the description of example embodiments of the disclosure set forth below, when read in conjunction with the accompanying drawings, in which:

DETAILED DESCRIPTION

The illustrations presented herein are not meant to be actual views of any particular earth-boring tool or component thereof, but are merely idealized representations that are employed to describe example embodiments of the disclosure. Elements common between figures may retain the same numerical designation.

In some embodiments, the disclosure includes earth-boring tools, such as rotary drill bits, that include two or more different types of cutting elements, one of which types comprises cutting elements that are impregnated with diamond particles. Additional types of cutting elements may include polycrystalline diamond compact (PDC) cutting elements, tungsten carbide cutting elements, or any other type of cutting element. In additional embodiments, earth-boring tools, such as rotary drill bits, include at least one diamond-impregnated cutting element having an elongated shape, which is mounted to a body of the bit at a surface thereof in an orientation such that a longitudinal axis of the cutting element is disposed at an acute angle to a line perpendicular (i.e., normal) to a plane tangent the surface of the body of the bit at the location at which the cutting element is mounted.

Figure 1:
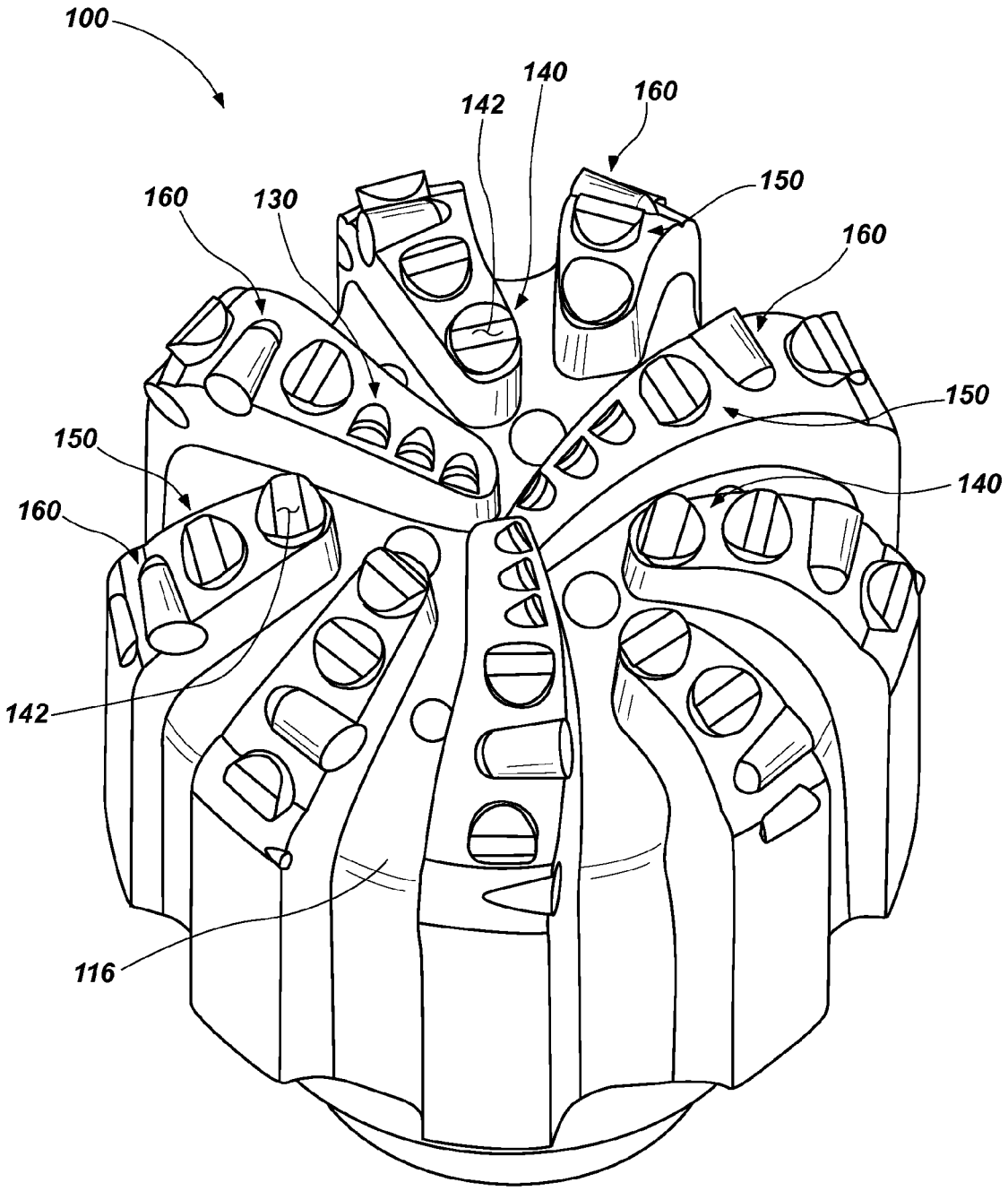
FIG. 1 is a perspective view of an embodiment of an earth-boring tool comprising a rotary drill bit.
Figure 2:
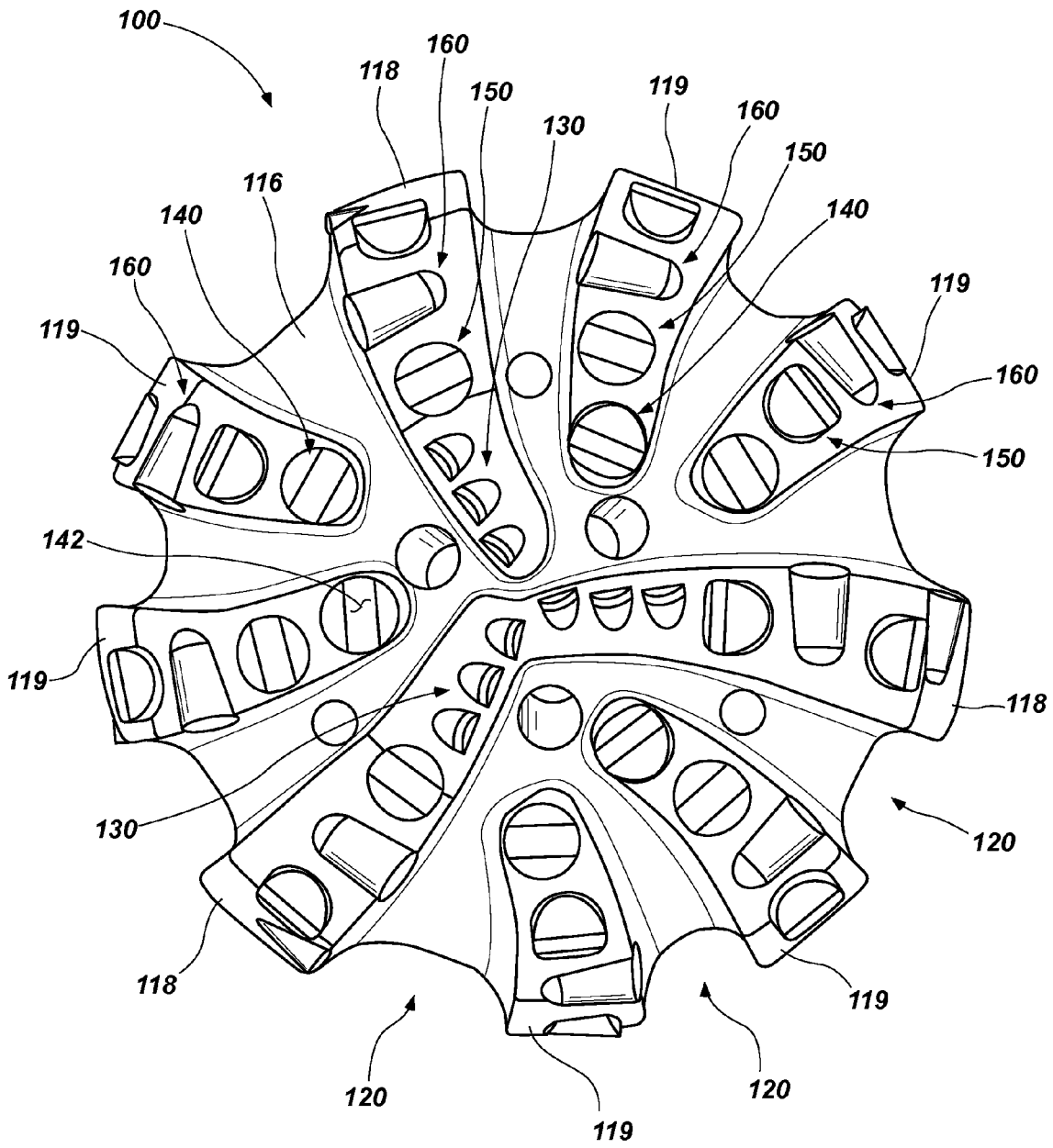
FIG. 2 is an end view illustrating a face of the drill bit shown in FIG. 1.
Figure 3:
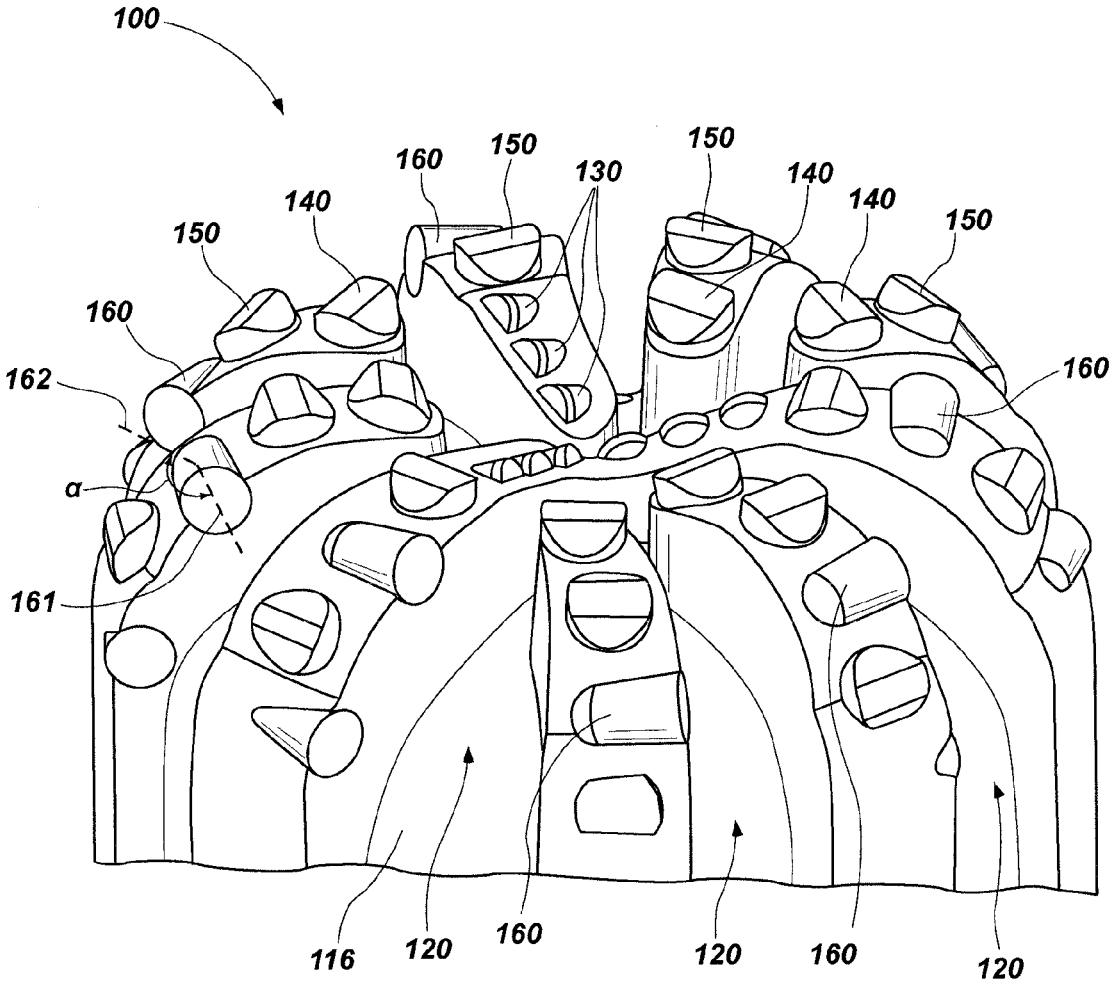
FIG. 3 is another perspective view of the drill bit shown in FIGS. 1 and 2.

A non-limiting embodiment of an earth-boring tool in the form of a rotary drill bit 100 is illustrated in FIGS. 1 through 3. The drill bit 100 includes a bit body comprising a crown region 116. The crown region 116 may comprise a particle-matrix composite material, which may include a plurality of hard particles (e.g., diamond particles, tungsten carbide particles, etc.) dispersed throughout a metal matrix material (e.g., a metal alloy based on one or more of copper, cobalt, nickel, iron, etc.). In other embodiments, the crown region 116 may be at least substantially comprised of metal or a metal alloy without including any hard particles therein. The crown region 116 may have a variety of configurations. For example, in some embodiments and as shown in FIG. 2, the crown region 116 may include a plurality of primary blades 118 and a plurality of secondary blades 119 that are separated from one another by fluid channels 120. In other embodiments, the crown region 116 may not include any blades 118, 119, and cutting elements may simply be mounted to a front cutting face of the bit body. The drill bit 100 may also include internal fluid passageways within the drill bit 100. The drill bit 100 includes a plurality of cutting elements, as discussed in further detail below.

The drill bit 100 may also include a metal shank (not shown) with one end attached or coupled to the crown region 116 and an opposing end having threads configured for attachment to a drill string (not shown). As known in the art, the bit body of the drill bit 100 may also include a metal blank (not shown) attached to the crown region 116 and used to attach the crown region 116 to such a metal shank. In other embodiments, however, the bit body may not include a metal blank, and the shank may be attached directly to the crown region 116. In yet further embodiments, the bit body may include a so-called "extension" or "cross-over" (which may be attached to the crown region 116 after formation of the crown region 116 as opposed to during formation of the crown region 116) instead of a metal blank. A metal blank may comprise a machinable metal or metal alloy such as, for example, a steel alloy, and may be configured for securing the crown region 116 of the bit body to a metal shank.

In some embodiments, the entire crown region 116 may be at least predominantly comprised of a particle-matrix composite material that includes a plurality of diamond particles. In additional embodiments, the diamond particles may only be distributed throughout an outer portion or cutting face of the crown region 116, which includes the blades 118, 119 and some of the cutting elements. The interior portion of the crown region 116 may comprise a particle-matrix composite material including hard particles, such as tungsten carbide, embedded within a matrix material, such as a copper-based, nickel-based, cobalt-based, or iron-based metal alloy. The interior portion may be at least substantially devoid of diamond particles. In yet further embodiments, only the blades 118, 119 and some of the cutting elements may comprise the diamond particles. Disposing diamond particles only in the cutting face of the crown region 116 may be more cost-effective than disposing diamond particles throughout the entire crown region 116 of the drill bit 100.

In some embodiments, the crown region 116 comprising the particle-matrix composite material, which may include diamond particles, may include additional hard particles (e.g., additional tungsten carbide particles). In additional embodiments, the crown region 116 comprising the particle-matrix composite material may be at least substantially devoid of additional hard particles. The diamond particles may be at least substantially uniformly distributed throughout the cutting face of the crown region 116. As the drill bit 100 drills into a rock formation, the metal matrix material surrounding the diamond particles may wear faster than diamond particles.

By way of example and not limitation, the bit body of the drill bit 100 may comprise a bit body as described in U.S. patent application Ser. No. 12/274,600, filed Nov. 20, 2008, and titled "Encapsulated Diamond Particles, Materials and Impregnated Diamond Earth-Boring Bits Including Such Particles, and Methods of Forming Such Particles, Materials, and Bits," the disclosure of which is incorporated herein in its entirety by this reference.

With continued reference to FIGS. 1 through 3, the drill bit 100 may include a plurality of different types of cutting elements 130, 140, 150, and/or 160.

Figure 4:
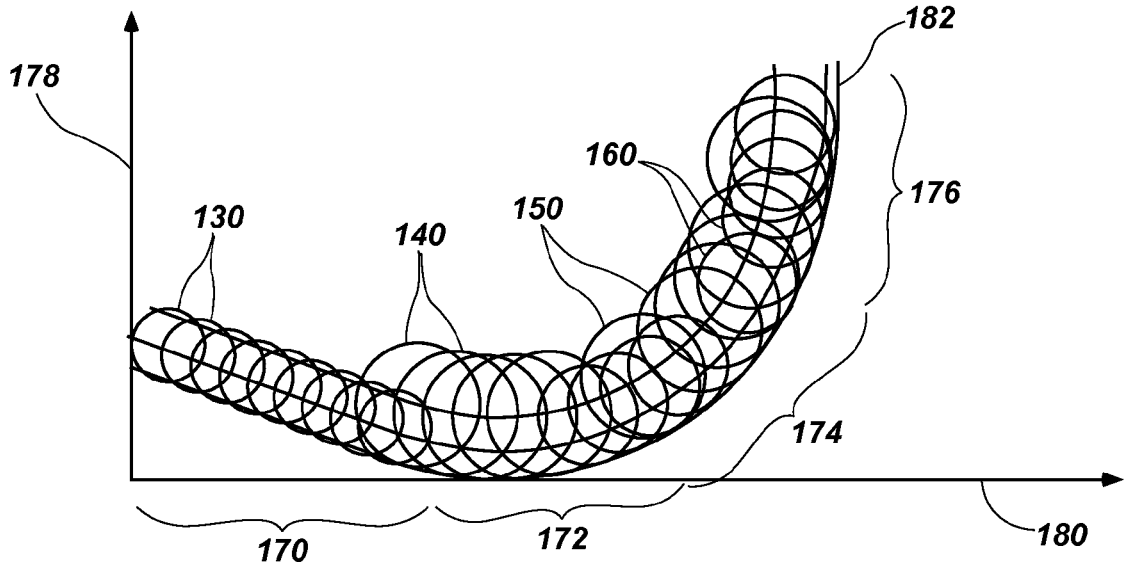
FIG. 4 is a diagram illustrating a cutting element profile of the drill bit shown in FIGS. 1 through 3.

FIG. 4 is a schematic diagram illustrating what is referred to in the art as a "cutting element profile" of the drill bit 100. The cutting element profile is a cross-sectional view of a single blade of the drill bit 100, and illustrates all of cutting elements 130, 140, 150, and 160 disposed thereon as if they were rotated onto the single illustrated blade. The cutting element profile may extend from a centerline of the bit body to the gage. Such cutting element profiles are often used in the art to design rotary drill bits and other earth-boring tools. Each of the cutting elements 130, 140, 150, and 160 is shown in relation to a vertical axis 178 and a horizontal axis 180. The vertical axis 178 represents an axis, conventionally the centerline of the bit, about which the drill bit rotates. The distance from each cutting element 130, 140, 150, and 160 to the vertical axis 178 corresponds to the radial position of that cutting element on the drill bit. The distance from each cutting element 130, 140, 150, and 160 to the horizontal axis 180 corresponds to the longitudinal position of that cutting element on the drill bit. Cutting elements 130, 140, 150, and 160 may be positioned along a selected cutting profile 182. As shown in FIG. 4, radially adjacent cutting elements 130, 140, 150, and/or 160 may overlap one another. Furthermore, two or more cutting elements 130, 140, 150, and/or 160 of a drill bit may be positioned at substantially the same radial and longitudinal position.

A first type of cutting elements includes a plurality of polycrystalline diamond compact (PDC) cutting elements 130. As known in the art, the face of a drill bit 100 like that shown in FIGS. 1 through 3 includes a plurality of regions between the central longitudinal axis (corresponding to vertical axis 178 in FIG. 4) of the bit 100 and the gage surfaces of the drill bit 100. These regions include a central cone region 170 having the shape of an inverted cone, a nose region 172 (which includes the most distal surfaces on the face of the drill bit 100), a shoulder region 174, and a gage region 176 (which includes the gage surfaces of the drill bit 100). In some embodiments of the disclosure, and as shown in FIGS. 1 through 4, the plurality of PDC cutting elements 130 may be disposed at least substantially entirely in a cone region 170 on the face of the drill bit 100. In other embodiments, any one or more of the cone region 170, the nose region 172, the shoulder region 174, and the gage region 176 of the drill bit 100 may include one or more PDC cutting elements 130. The cutting elements 130 may be mounted on the drill bit 100 with a selected back rake angle, a selected forward rake angle, and/or a selected side rake angle.

Figure 5:
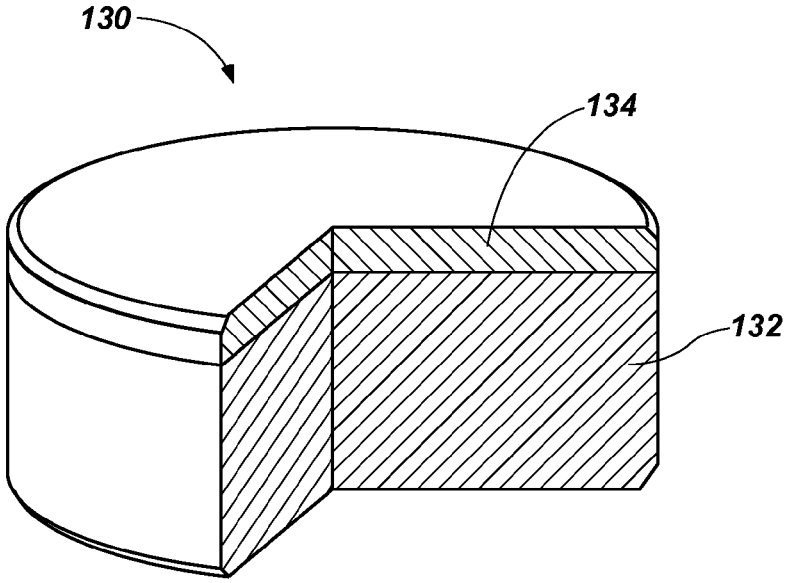
FIG. 5 is a partially cut-away perspective view of a polycrystalline diamond compact cutting element of the earth-boring tool shown in FIGS. 1 through 3.

FIG. 5 is a partially cut-away perspective view of an embodiment of a cutting element 130. The cutting element 130 includes a cutting element substrate 132 having a diamond table 134 thereon, although additional embodiments of the present disclosure may include PDC cutting elements that include a polycrystalline diamond compact (e.g., a diamond table) that is not attached to any substrate. With continued reference to FIG. 5, the diamond table 134 may be formed on the cutting element substrate 132, or the diamond table 134 and the substrate 132 may be separately formed and subsequently attached together.

The cutting element substrate 132 may have a generally cylindrical shape, as shown in FIG. 5. Although cutting element substrates commonly have a cylindrical shape, like the cutting element substrate 132, other shapes of cutting element substrates are also known in the art, and embodiments of the present disclosure include cutting elements having shapes other than a generally cylindrical shape. The cutting element substrate 132 may be formed from a material that is relatively hard and resistant to wear. For example, the cutting element substrate 132 may be formed from and include a ceramic-metal composite material (which may be referred to in the art as a "cermet" material). The cutting element substrate 132 may include a cemented carbide material, such as a cemented tungsten carbide material, in which tungsten carbide particles are cemented together in a metallic binder material. The metallic binder material may include, for example, cobalt, nickel, iron, or alloys and mixtures thereof.

The polycrystalline diamond material of the diamond table 134 may be formed by sintering and bonding together relatively small diamond grains or crystals under conditions of high temperature and high pressure in the presence of a catalyst (e.g., cobalt, iron, nickel, or alloys and mixtures thereof) to form the diamond table 134. These processes are referred to in the art as high temperature/high pressure (or "HTHP") processes. In embodiments in which the diamond table 134 is formed on the substrate 132, the cutting element substrate 132 may comprise a cermet material, such as cobalt-cemented tungsten carbide. In such instances, the cobalt or other catalyst material in the cutting element substrate 132 may be drawn into the diamond grains or crystals during sintering and serve as a catalyst for foaming a diamond table 134 from the diamond grains or crystals. In other methods, powdered catalyst material may be mixed with the diamond grains or crystals prior to sintering the grains or crystals together in an HTHP process.

Upon formation of a diamond table 134 using an HTHP process, catalyst material may remain in interstitial spaces between the grains or crystals of diamond in the resulting polycrystalline diamond table 134. The presence of the catalyst in the diamond table 134 may contribute to thermal damage in the diamond table 134 when the cutting element 130 is heated during use (e.g., due to friction at the contact point between the cutting element 130 and the formation). Polycrystalline diamond cutting elements in which the catalyst remains in the diamond table are generally thermally stable up to a temperature of about 750° Celsius, although internal stress within the polycrystalline diamond table may begin to develop at temperatures exceeding about 350° Celsius. Without being bound to a particular theory, it is believed that this internal stress is at least partially due to differences in the rates of thermal expansion between the diamond table and the cutting element substrate to which it is bonded. Thus, in some embodiments, catalyst material may be removed from between interbonded diamond grains in one or more portions of the diamond table 134, or throughout the diamond table 104.

Referring again to FIGS. 1 through 3, the drill bit 100 includes a plurality of cutting elements of a second type, which plurality includes diamond impregnated cutting elements 140. In some embodiments, the diamond impregnated cutting elements 140 may be integrally formed with blades on the crown region 116 of the drill bit 100, such as secondary blades 119 of the drill bit 100 (i.e., blades that do not extend entirely to the radial center of the drill bit 100). In some embodiments, the cutting elements 140 may have a post-like configuration having a generally cylindrical shape with an arcuate end surface 142. The arcuate end surface 142 may have a saddle shape. The cutting elements 140 may be formed on the drill bit 100 in an orientation such that a longitudinal axis of each cutting element 140 is disposed at least substantially perpendicular (i.e., normal) to a plane tangent the surface of the bit body at the location at which the cutting element 140 is formed. The cutting elements 140 may be formed at locations on the face of the drill bit 100 at which it may be difficult or impossible to attach other types of cutting elements, such as on the radially inward ends of secondary blades 119. Though shown on the secondary blades 119, the diamond impregnated cutting elements 140 may additionally or alternatively be formed with primary blades 118.

The diamond impregnated cutting elements 140 may include a particle matrix composite material that includes a first discontinuous phase comprising a superabrasive material (e.g., diamond, cubic boron nitride, etc.) dispersed within a continuous matrix phase (often referred to as a binder). The first discontinuous phase comprising a superabrasive material may comprise particles of a superabrasive material, such as particles of diamond and/or cubic boron nitride. The continuous matrix phase may comprise a metal or metal alloy, such as a copper-based alloy, an iron-based alloy, a nickel-based alloy, a cobalt-based alloy, an aluminum-based alloy, a titanium-based alloy, mixtures of such alloys, etc. In some embodiments, the particle-matrix composite material of the diamond impregnated cutting elements 140 may include one or more additional discontinuous phases dispersed throughout the matrix phase. For example, the particle-matrix composite material of the diamond impregnated cutting elements 140 may include a second discontinuous phase comprising a hard abrasive material such as a carbide (e.g., tungsten carbide, titanium carbide, tantalum carbide, or boron carbide), a boride (e.g., titanium boride, or silicon boride), a nitride (e.g., silicon nitride, boron nitride, or titanium nitride), etc., or mixtures thereof.

As discussed in further detail below, the diamond impregnated cutting elements 140 may be integrally formed with the crown region 116 of the bit body during manufacturing thereof by forming recesses in a mold having sizes and shapes corresponding to the diamond impregnated cutting elements 140 to be formed therein. Particles of superabrasive material and, optionally, particles of another hard abrasive material may be provided within the recesses in the mold. A molten matrix material then may be caused to infiltrate the particles of superabrasive material and any other particles of hard abrasive material within the recesses to form the diamond impregnated cutting elements 140 and the crown region 116 of the bit body.

A third type of cutting element includes a plurality of diamond impregnated cutting elements 150 formed separately from the blades 118, 119 and the crown region 116 of the drill bit 100 and subsequently attached thereto. In some embodiments, the cutting elements 150 may have a configuration substantially identical to that of the diamond impregnated cutting elements 140. The diamond impregnated cutting elements 150 may be mounted on the drill bit 100 in an orientation such that a longitudinal axis of each cutting element 150 is disposed at least substantially perpendicular (i.e., normal) to a plane tangent the surface of the bit body at the location at which the cutting element 150 is mounted.

The diamond impregnated cutting elements 150 may comprise a particle-matrix composite material that is similar to those described above in relation to the diamond impregnated cutting elements 140. The diamond impregnated cutting elements 150 may include a particle matrix composite material that includes a first discontinuous phase comprising a superabrasive material dispersed within a continuous matrix phase. The first discontinuous phase may be formed by particles of a superabrasive material, such as particles of diamond and/or cubic boron nitride. The continuous matrix phase may comprise a metal or metal alloy, such as a copper-based alloy, an iron-based alloy, a nickel-based alloy, a cobalt-based alloy, an aluminum-based alloy, a titanium-based alloy, mixtures of such alloys, etc. In some embodiments, the particle-matrix composite material of the diamond impregnated cutting elements 150 may include one or more additional discontinuous phases dispersed throughout the matrix phase. For example, the particle-matrix composite material of the diamond impregnated cutting elements 150 may include a second discontinuous phase comprising a hard abrasive material such as a carbide, a boride, a nitride, etc.

In contrast to the diamond impregnated cutting elements 140, however, the diamond impregnated cutting elements 150 may be formed separately from the crown region 116 of the bit body of the drill bit 100 and subsequently attached to the bit body, such as by brazing, welding, etc. For example, recesses having a size and shape configured to receive a portion of a diamond impregnated cutting element 150 therein may be formed in the crown region 116 either during formation of the crown region, or after forming the crown region 116.

The diamond impregnated cutting elements 150 may be formed by providing a particle mixture that includes a plurality of particles comprising a superabrasive material (e.g., diamond or cubic boron nitride) and a plurality of particles comprising a matrix material (e.g., a copper-based alloy, an iron-based alloy, a nickel-based alloy, a cobalt-based alloy, an aluminum-based alloy, a titanium-based alloy, mixtures of such alloys, etc). In some embodiments, the particles comprising the superabrasive material may comprise encapsulated and/or pelletized diamond particles. In some embodiments, the particles of matrix material may be provided as part of a coating on such encapsulated and/or pelletized diamond particles.

After providing the particle mixture, the particle mixture may be pressed in a cavity of a die or mold (axially pressed or isostatically pressed) to form a green body. The cavity of the die or mold, and, hence, the green body, may have a shape substantially corresponding to that of the diamond impregnated cutting elements 150 to be formed therefrom. The green body may be formed by cold pressing or hot pressing the particle mixture. After forming such a green body, the green body may be sintered (with or without applying pressure to the green body during the sintering process) to consolidate the particle mixture and faun the cutting element 150.

By way of example and not limitation, the diamond impregnated cutting elements 150 may comprise cutting structures as disclosed in, for example, U.S. Pat. No. 7,350,599, issued Apr. 1, 2008, and titled "Impregnated Diamond Cutting Structure," the disclosure of which is incorporated herein in its entirety by this reference.

Exposing particles of superabrasive material, such as diamond, to excessive thermal energy may result in degradation and/or decomposition of the superabrasive material. By separately forming the diamond impregnated cutting elements 150 from the crown region 116 of the bit body of the drill bit 100, the particles of superabrasive material in the diamond impregnated cutting elements 150 may be subjected to less thermal energy (e.g., lower temperatures, less time at elevated temperatures, etc.) compared to the particles of superabrasive material in the diamond impregnated cutting elements 140 integrally formed with the crown region 116 of the bit body in an infiltration process. Infiltration processes typically require relatively higher temperatures to maintain the matrix material in a molten state while the particles are at least substantially entirely infiltrated. Thus, the properties of the diamond impregnated cutting elements 150 may be more desirable in one or more aspects compared to the properties of the diamond impregnated cutting elements 140. The diamond impregnated cutting elements 140 may be used, however, at locations on the drill bit 100 at which it may be difficult or impossible to adequately secure diamond impregnated cutting elements 150 to the bit body, as mentioned above.

A fourth type of cutting element includes a plurality of diamond impregnated cutting elements 160 that have an elongated shape, and which are mounted to the bit body at a surface thereof in an orientation such that a longitudinal axis 161 of each cutting element 160 is disposed at an acute angle $\alpha$ to a line 162 perpendicular (i.e., normal) to a plane tangent the surface of the bit body at the location at which the cutting element 160 is disposed. The acute angle $\alpha$ may be in a range extending from about one degree (1° ) to about eighty-nine degrees (89° ). More particularly, the acute angle $\alpha$ may be in a range extending from about five degrees (5° ) to about seventy degrees (70° ). In yet further embodiments, the acute angle $\alpha$ may be in a range extending from about ten degrees (10° ) to about sixty degrees (60° ). The acute angle $\alpha$ may be positive or negative. Thus, the diamond impregnated cutting elements 160 may be mounted on the drill bit 100 with a selected back rake angle, a selected forward rake angle, and/or a selected side rake angle.

The cutting elements 160 may be integrally fox med with the blades 118, 119 and the crown region 116 of the drill bit 100, or they may be formed separately from the blades 118, 119 and the crown region 116 of the drill bit 100 and subsequently attached thereto. In other words, the composition of the diamond impregnated cutting elements 160 may be at least substantially identical to those described above in relation to the diamond impregnated cutting elements 140, and may be formed as previously described in relation to the diamond impregnated cutting elements 140. In other embodiments, the composition of the diamond impregnated cutting elements 160 may be at least substantially identical to those described above in relation to the diamond impregnated cutting elements 150, and may be formed as previously described in relation to the diamond impregnated cutting elements 150.

As shown in FIGS. 1 through 3, in some embodiments of the disclosure, one or more of the primary blades 118 and the secondary blades 119 of the drill bit 100 may include two or more different types of cutting elements.

For example, one or more of the primary blades 118 of the drill bit 100 may include a plurality of PDC cutting elements 130 in the cone region 170 of the blades 118. One or more of the primary blades 118 of the drill bit 100 may also include alternating diamond impregnated cutting elements 150 and diamond impregnated cutting elements 160, which may be positioned over the nose region 172 and the shoulder region 174 of primary blades 118.

In some embodiments, one or more of the primary blades 118 may include at least one diamond impregnated cutting element 150 disposed directly between two other cutting elements of a different type on the same primary blade 118. The two other cutting elements may include one or more of a PDC cutting element 130, a diamond impregnated cutting element 140, and/or a diamond impregnated cutting element 160. One or more of the primary blades 118 may include at least one diamond impregnated cutting element 160 disposed directly between two other cutting elements of a different type on the same primary blade 118. The two other cutting elements may include one or more of a PDC cutting element 130, a diamond impregnated cutting element 140, and/or a diamond impregnated cutting element 150. Although not shown in FIGS. 1 through 3, one or more of the primary blades 118 may include at least one diamond impregnated cutting element 140.

With continued reference to FIGS. 1 through 3, in some embodiments of the disclosure, one or more of the secondary blades 119 of the drill bit 100 also may include two or more different types of cutting elements. For example, one or more of the secondary blades 119 of the drill bit 100 may include alternating diamond impregnated cutting elements 150 and diamond impregnated cutting elements 160, which may be positioned over a nose region 172 and/or a shoulder region 174 of the secondary blades 119.

In some embodiments, one or more of the secondary blades 119 may include at least one diamond impregnated cutting element 150 disposed directly between two other cutting elements of a different type on the same secondary blade 119. The two other cutting elements may include one or more of a PDC cutting element 130, a diamond impregnated cutting element 140, and/or a diamond impregnated cutting element 160. Furthermore, each of the secondary blades 119 may include at least one diamond impregnated cutting element 160 disposed directly between two other cutting elements of a different type on the same secondary blade 119. The two other cutting elements may include one or more of a PDC cutting element 130, a diamond impregnated cutting element 140, and/or a diamond impregnated cutting element 150. Although not shown in FIGS. 1 through 3, one or more of the secondary blades 118 may include at least one PDC cutting element 130.

Furthermore, one or more of the cutting elements 130, 140, 150, 160 may comprise a backup cutting element that is positioned to "back up" another primary cutting element 130, 140, 150, 160. A backup cutting element is a cutting element that is located at substantially the same radial and longitudinal position on a drill bit as another cutting element (i.e., a primary cutting element), such that the backup cutting element follows the kerf cut by the primary cutting element. In other words, the backup cutting element at least substantially follows the same cutting path as the corresponding primary cutting element during a drilling operation. Corresponding backup cutting elements and primary cutting elements may be disposed on different blades, or they may be disposed on the same blade.

Figure 6:
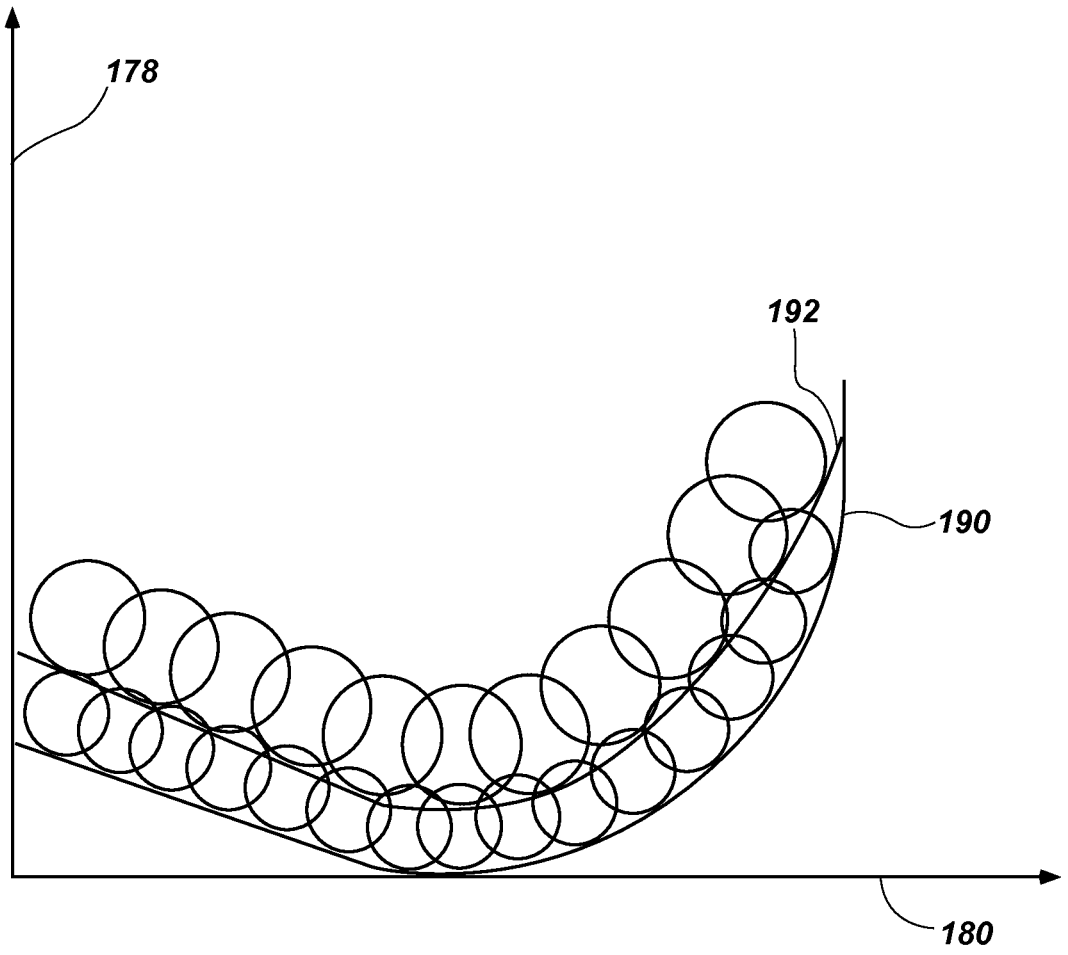
FIG. 6 is a diagram illustrating a cutting element profile of another embodiment of an earth-boring tool comprising a rotary drill bit.

FIG. 6 illustrates a cutting element profile that may be exhibited by additional embodiments of drill bits or other earth-boring tools of the current disclosure. Like FIG. 4, FIG. 6 illustrates a cross-sectional view of a single blade and illustrates the cutting elements of the drill bit as if all of the cutting elements were rotated onto that single blade. The drill bit 100 may include a combined first cutting profile 190 defined by the PDC cutting elements 130 and a second cutting profile 192 defined by the diamond impregnated cutting elements 140, 150, 160. The drill bit 100 may be designed by combining a selected first cutting profile with a selected second cutting profile.

In some embodiments, the first cutting profile and the second cutting profile may have different exposure levels. In such embodiments, one of the plurality of PDC cutting elements 130 and the plurality of diamond impregnated cutting elements 140, 150, 160 may be positioned to engage a formation first upon commencement of a drilling operation (without engaging the other), and the other cutting elements may engage the formation only after the first cutting elements have worn to a predetermined extent.

Bit bodies may be formed by various techniques. For example, bit bodies of earth-boring rotary drill bits, such as the bit body of the drill bit 100 shown in FIGS. 1 through 3, may be formed using, for example, so-called "infiltration" casting techniques. In such embodiments, a mold (not shown) may be provided that includes a mold cavity having a size and shape corresponding to the size and shape of the bit body. In other words, the surfaces of the mold within the mold cavity may have a shape corresponding to the shape of the crown region 116 including recesses in the shape of the blades 118 and any cutting elements that are to be integrally formed with the crown region 116, such as the diamond impregnated cutting elements 140. The mold may be fowled from, for example, graphite or any other high-temperature refractory material, such as a ceramic material. The mold cavity of the mold may be machined using a multi-axis (e.g., 5-, 6-, or 7-axis) machining system. Fine features may be added to the cavity of the mold using hand-held tools. Additional clay work also may be required to obtain the desired configuration of some features of the bit body. Where necessary, preform elements, which are termed "displacements" in the art (which may comprise ceramic components, graphite components, or resin-coated sand compact components) may be positioned within the mold cavity and used to define the internal fluid passageways and external topographic features of bit body. Such preform elements may be used to form recesses or pockets configured to receive portions of cutting elements therein, such as PDC cutting elements 130, diamond impregnated cutting elements 150, and/or diamond impregnated cutting elements 160.

After forming the mold, diamond particles or particles of another superabrasive material may be placed within the mold cavity in regions corresponding to surfaces proximate the face of the drill bit 100 to be formed therein. In some embodiments, no additional hard particles (other than the diamond particles) may be provided within the mold cavity. In additional embodiments, at least a portion of the mold cavity may be packed with a plurality of hard particles, such as tungsten carbide particles. Optionally, a metal blank may be at least partially embedded within the particle bed such that at least one surface of the metal blank is exposed to allow subsequent machining of the surface of the metal blank (if necessary or desirable) and subsequent attachment thereof to the metal shank.

Molten matrix material then may be allowed or caused to infiltrate the spaces between the particles within the mold cavity. Particles or bodies of matrix material may be placed on top of the particle bed within the mold cavity. The mold may then be placed into a furnace to melt the particles or bodies of matrix material. As the particles or bodies of matrix material melt, the molten metal matrix material may flow into and infiltrate the spaces between the particles in the powder bed within the mold cavity.

In additional embodiments, particles of matrix material may be mixed with superabrasive and hard particles within the mold cavity. The mold may then be placed in a furnace to melt the matrix material, and the molten matrix material may fill and infiltrate the spaces between particles in the powder bed. The matrix material may substantially fill the spaces between the superabrasive and hard particles, forming a fully dense body substantially free of voids.

In yet further embodiments, the matrix material may be melted in a separate container, and the molten matrix material may be poured onto the particle bed and allowed to flow into and infiltrate the spaces between the particles in the powder bed within the mold cavity.

Because the molten matrix material may be susceptible to oxidation, the infiltration process may be carried out under vacuum or in an inert atmosphere. In some embodiments, pressure may be applied to the molten metal matrix material to facilitate the infiltration process and to substantially prevent the formation of voids within the bit body being formed.

After infiltrating the superabrasive and other hard particles within the mold cavity with molten matrix material, the molten metal matrix material may be allowed to cool and solidify around the superabrasive and other hard particles, thereby forming a particle-matrix composite material.

In additional embodiments, the crown region 116 of the bit body, which includes the blades 118, 119, may be formed using so-called particle compaction and sintering techniques such as those disclosed in U.S. Pat. No. 7,802,495, issued Sep. 28, 2010, and titled Methods of Forming Earth-Boring Rotary Drill Bits, and U.S. Pat. No. 7,776,256, issued Aug. 17, 2010, and titled Earth-Boring Rotary Drill Bits and Methods of Manufacturing Earth-Boring Rotary Drill Bits Having Particle-Matrix Composite Bit Bodies, the entire disclose of each of which is incorporated herein by this reference.

Briefly, a powder mixture may be pressed to form a green bit body or billet, which then may be sintered one or more times to form a bit body having a desired final density. The powder mixture may include a plurality of diamond particles or particles of another superabrasive material as well as a plurality of particles comprising a metal matrix material. In some embodiments, the powder mixture may be free of any additional particles, such as particles of tungsten carbide. Optionally, the powder mixture may further include additives commonly used when pressing powder mixtures, such as organic binders for providing lubrication during pressing and for providing structural strength to the pressed powder component, plasticizers for making the binder more pliable, and lubricants or compaction aids for reducing inter-particle friction. Furthermore, the powder mixture may be milled with the particles of metal matrix material in, for example, a ball milling process, which may result in the diamond particles being at least partially coated with metal matrix material.

The powder mixture may be pressed (e.g., axially within a mold or die, or substantially isostatically within a mold or container) to form a green bit body. The green bit body may be machined or otherwise shaped prior to sintering to form features such as blades, fluid courses, internal longitudinal bores, cutting element pockets, etc. In some embodiments, the green bit body (with or without machining) may be partially sintered to form a brown bit body, and the brown bit body may be machined or otherwise shaped prior to sintering the brown bit body to a desired final density to form one or more such features.

The sintering processes may include conventional sintering in a vacuum furnace, sintering in a vacuum furnace followed by a conventional hot isostatic pressing process, or sintering immediately followed by isostatic pressing at temperatures near the sintering temperature (often referred to as sinter-HIP). Furthermore, the sintering processes may include subliquidus phase sintering. In other words, the sintering processes may be conducted at temperatures proximate to but below the liquidus line of the phase diagram for the matrix material. For example, the sintering processes may be conducted using a number of different methods known to those of ordinary skill in the art, such as the Rapid Omnidirectional Compaction (ROC) process, the quasi-isostatic hot consolidation process known by the trade name CERACON®, hot isostatic pressing (HIP), or adaptations of such processes.

When the bit body is formed by particle compaction and sintering techniques, the bit body may not include a metal blank and may be secured to the metal shank by, for example, one or more of brazing or welding. Furthermore, in such embodiments, an extension comprising a machinable metal or metal alloy (e.g., a steel alloy) may be secured to the bit body and used to secure the bit body to a shank.

In yet further embodiments, the bit body of the drill bit 100 may comprise a metal alloy (e.g., a steel alloy) formed by machining a forged or cast metal alloy body.

Figure 7:
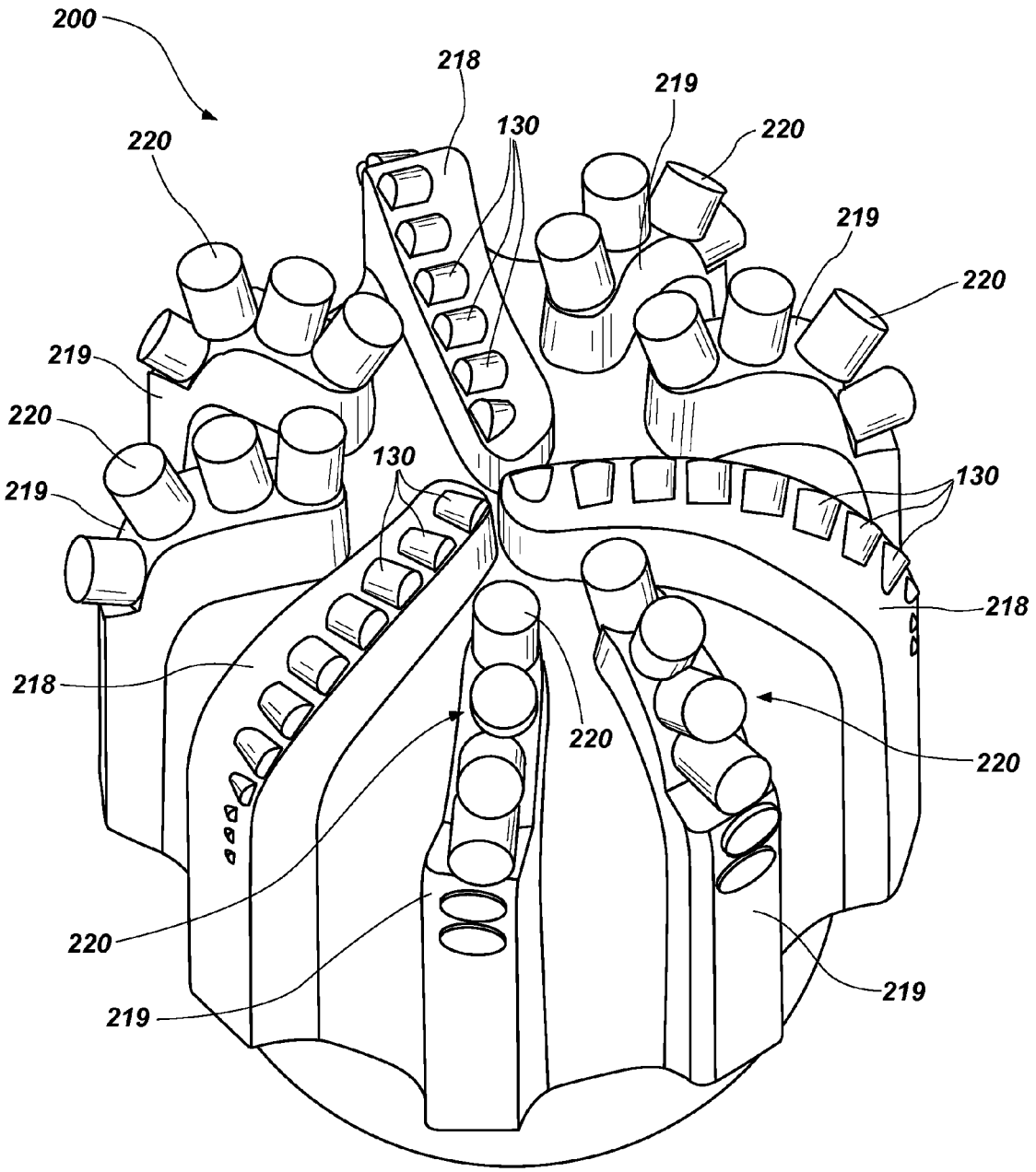
FIG. 7 is a simplified perspective view illustrating another embodiment of an earth-boring tool comprising a rotary drill bit.
Figure 8:
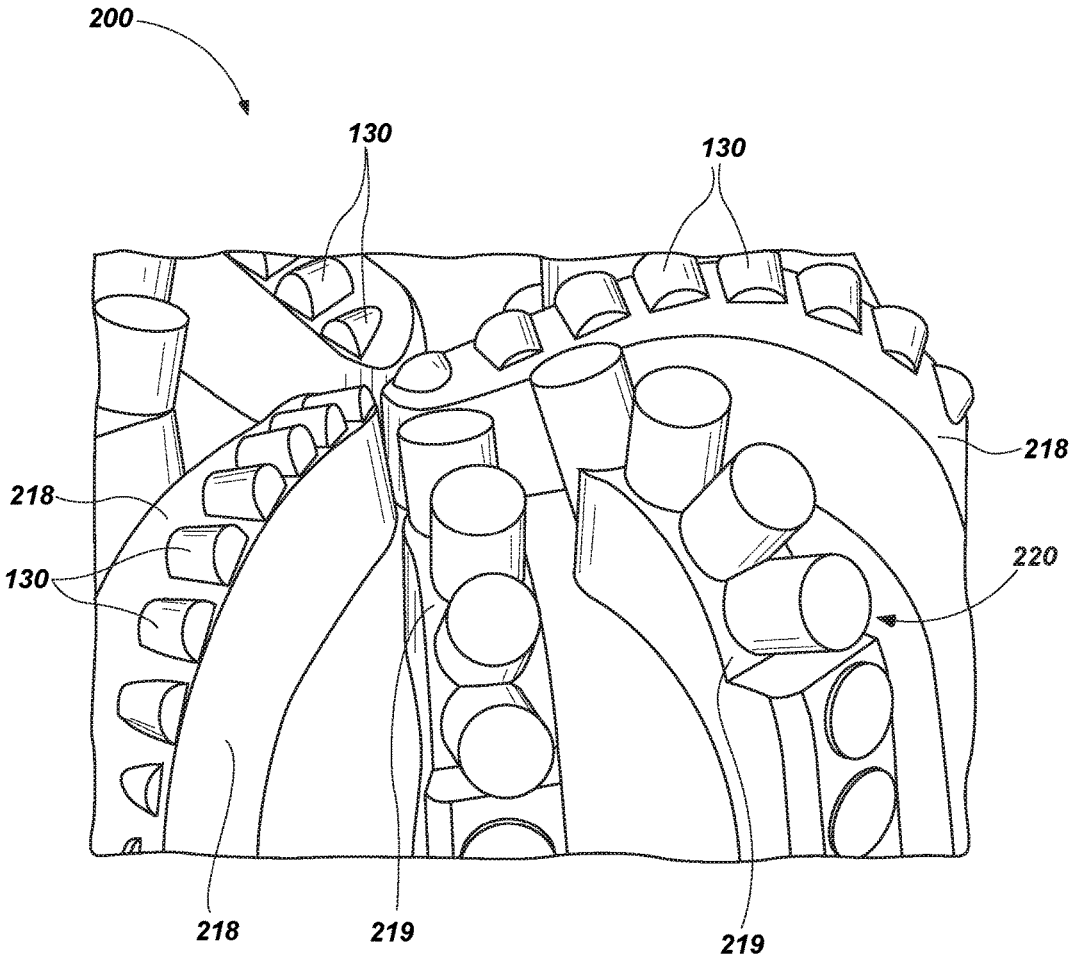
FIG. 8 is another perspective view of the drill bit shown in FIG. 7.

FIGS. 7 and 8 illustrate another example embodiment of a drill bit 200 of the disclosure. The drill bit 200 shown in FIGS. 7 and 8 includes three primary blades 218 and six secondary blades 219. Each of the primary blades 218 of the drill bit 200 may have a plurality of PDC cutting elements 130 mounted thereon. Each of the secondary blades 219 of the drill bit 200 has a plurality of diamond impregnated cutting elements 220 thereon.

The diamond impregnated cutting elements 220 may comprise a particle-matrix composite material similar to those described above in relation to the diamond impregnated cutting elements 140, 150, and 160 of the drill bit 100 shown in FIGS. 1 through 3. The diamond impregnated cutting elements 220 may include a particle matrix composite material that includes a first discontinuous phase comprising a superabrasive material dispersed within a continuous matrix phase. The first discontinuous phase comprising a superabrasive material may be formed by particles of a superabrasive material, such as particles of diamond and/or cubic boron nitride. The continuous matrix phase may comprise a metal or metal alloy, such as a copper-based alloy, an iron-based alloy, a nickel-based alloy, a cobalt-based alloy, an aluminum-based alloy, a titanium-based alloy, mixtures of such alloys, etc. In some embodiments, the particle-matrix composite material of the diamond impregnated cutting elements 220 may include one or more additional discontinuous phases dispersed throughout the matrix phase. For example, the particle-matrix composite material of the diamond impregnated cutting elements 220 may include a second discontinuous phase comprising a hard abrasive material such as a carbide (e.g., tungsten carbide), a boride, a nitride, etc.

Further, the diamond impregnated cutting elements 220 may be formed using any of the methods described above in relation to the diamond impregnated cutting elements 140, 150, and 160 of the drill bit 100 shown in FIGS. 1 through 3. In some embodiments, one or more of the diamond impregnated cutting elements 220 may be integrally formed with the bit body of the drill bit 200, as described above in relation to the diamond impregnated cutting elements 140 of the drill bit 100 of FIGS. 1 through 3. In some embodiments, one or more of the diamond impregnated cutting elements 220 may be separately formed from the bit body of the drill bit 200 and subsequently attached thereto, as described above in relation to the diamond impregnated cutting elements 150 of the drill bit 100 of FIGS. 1 through 3.

As shown in FIGS. 7 and 8, each of the diamond impregnated cutting elements 220 may have a post-like configuration, and may have a generally cylindrical shape comprising a cylindrical lateral side surface extending to and intersecting a substantially planar end surface. In additional embodiments, the diamond impregnated cutting elements 220 may have any other configuration, such as a configuration like any of the previously described diamond impregnated cutting elements 140, 150, or 160.

As shown in FIGS. 7 and 8, in some embodiments, each primary blade 218 may include only PDC cutting elements 130, and each secondary blade 219 may include only diamond impregnated cutting elements 220. In other words, the primary blades 218 may include no diamond impregnated cutting elements 220, and the secondary blades 219 may include no PDC cutting elements 130. In additional embodiments, each primary blade 218 may include only diamond impregnated cutting elements 220, and each secondary blade 219 may include only PDC cutting elements 130.

In some embodiments, the PDC cutting elements 130 may be mounted on the drill bit 200 with a first selected exposure level, and the diamond impregnated cutting elements 220 may be mounted on the drill bit 200 with a second, different selected exposure level. In such embodiments, one of the plurality of PDC cutting elements 130 and the plurality of diamond impregnated cutting elements 220 may be positioned to engage a formation first upon commencement of a drilling operation (without engaging the other), and the other plurality of cutting elements may engage the formation only after the first plurality of cutting elements have engaged the formation and worn to a predetermined extent. The cutting properties of the drill bit 200 may be varied for a selected application by varying the exposure level of one plurality of cutting elements with respect to the other.

Additional non-limiting example embodiments of the disclosure are described below.

Embodiment 1: An earth-boring tool comprising a bit body, a plurality of first cutting elements, and a plurality of second cutting elements. Each of the first cutting elements comprises a first discontinuous phase dispersed within a continuous matrix phase. The first discontinuous phase comprises a plurality of particles of superabrasive material. Each of the second cutting elements comprises at least one of a polycrystalline diamond compact and tungsten carbide.

Embodiment 2: The earth-boring tool of Embodiment 1, wherein the cutting elements of the plurality of first cutting elements are attached to the bit body.

Embodiment 3: The earth-boring tool of Embodiment 1, wherein the cutting elements of the plurality of first cutting elements are integral to the bit body.

Embodiment 4: The earth-boring tool of any of Embodiments 1 through 3, wherein at least one cutting element of the plurality of first cutting elements is oriented at an acute angle to a line perpendicular to a plane tangent a surface of the bit body at a location at which the cutting element is disposed.

Embodiment 5: The earth-boring tool of Embodiment 4, wherein the acute angle is from about 1° to about 89°.

Embodiment 6: The earth-boring tool of Embodiment 5, wherein the acute angle is from about 5° to about 70°.

Embodiment 7: The earth-boring tool of Embodiment 6, wherein the acute angle is from about 10° to about 60°.

Embodiment 8: The earth-boring tool of any of Embodiments 1 through 7, wherein the plurality of first cutting elements forms a first cutting profile, and the plurality of second cutting elements forms a second cutting profile different from the first cutting profile.

Embodiment 9: The earth-boring tool of Embodiment 8, wherein one of the plurality of first cutting elements and the plurality of second cutting elements is positioned to engage the formation upon commencement of a drilling operation. The other of the plurality of first cutting elements and the plurality of second cutting elements is positioned to engage the formation only after at least one of the plurality of first cutting elements or the plurality of second cutting elements has worn to a predetermined extent.

Embodiment 10: The earth-boring tool of any of Embodiments 1 through 9, wherein the first discontinuous phase comprises particles of at least one of diamond and cubic boron nitride.

Embodiment 11: The earth-boring tool of any of Embodiments 1 through 10, wherein the continuous matrix phase comprises a metal or metal alloy selected from the group consisting of a copper-based alloy, an iron-based alloy, a nickel-based alloy, a cobalt-based alloy, an aluminum-based alloy, a titanium-based alloy, and mixtures of such alloys.

Embodiment 12: The earth-boring tool of any of Embodiments 1 through 11, wherein each cutting element of the plurality of first cutting elements further comprises a second discontinuous phase dispersed within the continuous matrix phase, the second discontinuous phase comprising a plurality of particles of hard abrasive material selected from the group consisting of carbides, borides, nitrides, and mixtures thereof.

Embodiment 13: The earth-boring tool of Embodiment 12, wherein the hard abrasive material of the plurality of particles of hard abrasive material is selected from the group consisting of tungsten carbide, titanium carbide, tantalum carbide, boron carbide, titanium boride, silicon boride, silicon nitride, boron nitride, titanium nitride, and mixtures thereof.

Embodiment 14: A method of forming an earth-boring tool, comprising disposing a plurality of first cutting elements on a bit body and disposing a plurality of second cutting elements on the bit body. Each cutting element of the plurality of first cutting elements comprising a first discontinuous phase comprising a plurality of particles of superabrasive material dispersed within a continuous matrix phase. Each cutting element of the plurality of second cutting elements comprising at least one of a polycrystalline diamond compact and tungsten carbide.

Embodiment 15: The method of Embodiment 14, further comprising disposing the plurality of superabrasive particles within a mold and infiltrating the superabrasive particles with a molten matrix material to form the cutting elements of the plurality of first cutting elements.

Embodiment 16: The method of Embodiment 14 or Embodiment 15, further comprising coating each of the plurality of superabrasive particles with a matrix material, disposing the plurality of superabrasive particles within a mold, and heating the plurality of superabrasive particles to melt the matrix material.

Embodiment 17: The method of any of Embodiments 14 through 16, further comprising disposing at least one cutting element of the plurality of first cutting elements at an acute angle to a line perpendicular to a plane tangent a surface of the bit body at a location at which the cutting element is disposed.

Embodiment 18: The method of any of Embodiments 14 through 17, further comprising forming a first cutting profile from the plurality of first cutting elements and forming a second cutting profile from the plurality of second cutting elements, the second cutting profile different from the first cutting profile.

Embodiment 19: The method of any of Embodiments 14 through 18, further comprising configuring one of the plurality of first cutting elements and the plurality of second cutting elements to engage the formation upon commencement of a drilling operation, and configuring the other of the plurality of first cutting elements and the plurality of second cutting elements to engage the formation only after at least one of the plurality of first cutting elements or the plurality of second cutting elements has worn to a predetermined extent.

Embodiment 20: A method of forming an earth-boring tool, comprising forming a body having a plurality of first cutting elements and a plurality of cutting element pockets, and securing each of a plurality of second cutting elements within each of the cutting element pockets. Each first cutting element comprises a first discontinuous phase comprising a plurality of particles of superabrasive material dispersed within a continuous matrix phase. Each cutting element of the second plurality comprises at least one of a polycrystalline diamond compact and tungsten carbide.

Embodiment 21: The method of Embodiment 20, wherein forming a body comprises disposing the plurality of particles of superabrasive material within a mold configured to define at least one surface of the drill bit, and infiltrating the particles of superabrasive material with a molten matrix material.

Embodiment 22: The method of Embodiment 20 or Embodiment 21, wherein forming a body having a plurality of first cutting elements comprises forming a plurality of arcuate end surfaces.

Embodiment 23: The method of any of Embodiments 20 through 22, wherein forming a body having a plurality of first cutting elements comprises forming the plurality of first cutting elements on radially inward ends of a plurality of secondary blades of the body.

Embodiment 24: The method of any of Embodiments 20 through 22, wherein forming a body having a plurality of first cutting elements comprises forming a first cutting profile, and securing each of a second plurality of second cutting elements within each of the cutting element pockets comprises forming a second cutting profile different from the first cutting profile.

While the present disclosure has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventors. Further, embodiments of the disclosure have utility with different and various bit profiles as well as cutting element types and configurations.

What is claimed is:

1. An earth-boring tool, comprising:

a bit body comprising diamond particles, the bit body defining an exterior surface; and cutting elements defining a cutting element profile of the earth-boring tool;

wherein the cutting elements include:

a first plurality of cutting elements integral to the bit body and comprising primary cutting elements in the cutting element profile of the earth-boring tool, each cutting element of the first plurality of cutting elements comprising a discontinuous phase dispersed within a continuous matrix phase, the discontinuous phase comprising the diamond particles, the continuous matrix phase comprising a metal or a metal alloy selected from the group consisting of a copper-based alloy, an iron-based alloy, a nickel-based alloy, a cobalt-based alloy, an aluminum-based alloy, a titanium-based alloy, and mixtures of such alloys; and a second plurality of cutting elements also comprising primary cutting elements in the cutting element profile of the earth-boring tool, each cutting element of the second plurality of cutting elements comprising at least one of a polycrystalline diamond compact and tungsten carbide;

wherein at least one of the first plurality of cutting elements and at least one of the second plurality of cutting elements are oriented at an acute angle to a line perpendicular to a plane tangent the exterior surface of the bit body at a location at which the cutting element is disposed.

2. The earth-boring tool of claim 1, further comprising a third plurality of cutting elements attached to the bit body and disposed substantially along a line between a central longitudinal axis of the bit body and a point along an outer diameter of the bit body, each comprising a discontinuous phase dispersed within a continuous matrix phase, the discontinuous phase comprising a plurality of particles of superabrasive material.

3. The earth-boring tool of claim 1, wherein at least one cutting element of the plurality of first cutting elements is oriented at an acute angle to a line perpendicular to a plane tangent a surface of the bit body at a location at which the cutting element is disposed, wherein the acute angle is from about 1° to about 89°.

4. The earth-boring tool of claim 3, wherein the acute angle is from about 5° to about 70°.

5. The earth-boring tool of claim 4, wherein the acute angle is from about 10° to about 60°.

6. The earth-boring tool of claim 1, wherein each cutting element of the first plurality of cutting elements further comprises a second discontinuous phase dispersed within the continuous matrix phase, the second discontinuous phase comprising a plurality of particles of hard abrasive material selected from the group consisting of carbides, borides, nitrides, and mixtures thereof.

7. The earth-boring tool of claim 6, wherein the hard abrasive material of the plurality of particles of hard abrasive material is selected from the group consisting of tungsten carbide, titanium carbide, tantalum carbide, boron carbide, titanium boride, silicon boride, silicon nitride, boron nitride, titanium nitride, and mixtures thereof.

8. The earth-boring tool of claim 1, further comprising a blade, and wherein at least one of the first plurality of cutting elements is disposed on the blade directly between two cutting elements of the second plurality of cutting elements disposed on the blade.

9. The earth-boring tool of claim 1, wherein the cutting elements of the first plurality are disposed in a first region on a face of the bit body, and the cutting elements of the second plurality are disposed in a second region on the face of the bit body, the second region being radially adjacent to the first region and located closer to the central longitudinal axis of the bit body relative to the first region.

10. The earth-boring tool of claim 1, wherein the cutting elements further comprise a third plurality of cutting elements integral to the bit body and comprising secondary cutting elements in the cutting element profile of the earth-boring tool, each cutting element of the third plurality of cutting elements comprising a discontinuous phase dispersed within a continuous matrix phase.

11. The earth-boring tool of claim 10, wherein the cutting elements further comprise a fourth plurality of cutting elements, wherein a longitudinal axis of at least one cutting element of the fourth plurality of cutting elements passing through a cutting face thereof is oriented normal to a plane tangent a surface of the bit body at a location at which the cutting element is disposed.

12. The earth-boring tool of claim 11, further comprising a blade, and wherein at least one of the third plurality of cutting elements is disposed on the blade directly between two cutting elements of the fourth plurality of cutting elements disposed on the blade.

13. The earth-boring tool of claim 1, wherein the first plurality of cutting elements comprises at least one cutting element in a crown region of the bit body, and wherein the second plurality of cutting elements comprises at least one cutting element in a cone region of the bit body.

14. A method of forming an earth-boring tool, comprising:

forming a first plurality of cutting elements integrally on a bit body comprising diamond particles, each cutting element of the first plurality of cutting elements comprising a discontinuous phase comprising a plurality of the diamond particles dispersed within a continuous matrix phase, the first plurality of cutting elements comprising primary cutting elements in a cutting element profile of the earth-boring tool, the continuous matrix phase comprising a metal or a metal alloy selected from the group consisting of a copper-based alloy, an iron-based alloy, a nickel-based alloy, a cobalt-based alloy, an aluminum-based alloy, a titanium-based alloy, and mixtures of such alloys;

disposing a cutting element of a second plurality of cutting elements in cutting element pockets of the bit body, each cutting element of the second plurality of cutting elements comprising at least one of a polycrystalline diamond compact and tungsten carbide, the second plurality of cutting elements also comprising primary cutting elements in the cutting element profile of the earth-boring tool;

wherein at least one of the first plurality of cutting elements and at least one of the second plurality of cutting elements are oriented at an acute angle to a line perpendicular to a plane tangent an exterior surface of the bit body at a location at which the cutting element is disposed.

15. The method of claim 14, further comprising disposing the plurality of the diamond particles within a mold and infiltrating the diamond particles with a molten matrix material to form the cutting elements of the plurality of first cutting elements.

16. The method of claim 15, further comprising coating each of the plurality of diamond particles with a matrix material.

17. The method of claim 14, wherein forming the first plurality of cutting elements integrally on the bit body further comprises forming the first plurality of cutting elements in a first region on a face of the bit body, and disposing the second plurality of cutting elements on the bit body further comprises disposing the second plurality of cutting elements in a second region on the face of the bit body, the second region located radially adjacent the first region and closer to the central longitudinal axis of the bit body relative to the first region.

18. A method of forming an earth-boring tool, comprising:

forming a body comprising diamond particles and having a portion of a first plurality of cutting elements integral with the body and another portion of the first plurality of cutting elements secured to the body, each first cutting element comprising a discontinuous phase comprising a plurality of particles of superabrasive material dispersed within a continuous matrix phase, each of the first plurality of cutting elements located and configured on the body as a primary cutting element in a cutting element profile of the earth-boring tool, wherein a longitudinal axis of at least one cutting element of the first plurality of cutting elements passing through a cutting face thereof is oriented at an acute angle to a line perpendicular to a plane tangent a surface of the body at a location at which the cutting element is disposed;

forming a plurality of cutting element pockets; and securing a second plurality of cutting elements within cutting element pockets of the plurality of cutting element pockets, each cutting element of the second plurality comprising at least one of a polycrystalline diamond compact and tungsten carbide, each of the second plurality of cutting elements also located and configured on the body as a primary cutting element in the cutting element profile of the earth-boring tool.

19. The method of claim 18, wherein forming a body comprises:

disposing the plurality of particles of superabrasive material within a mold configured to define at least one surface of the drill bit; and infiltrating the particles of superabrasive material with a molten matrix material.

20. The method of claim 18, wherein forming a body having a portion of a first plurality of cutting elements integral with the body and another portion of the first plurality of cutting elements secured to the body comprises forming a plurality of arcuate end surfaces.

21. The method of claim 18, wherein forming a body having a portion of a first plurality of cutting elements integral with the body comprises forming the portion of the first plurality of cutting elements integral with the body on radially inward ends of a plurality of secondary blades of the body.

22. The method of claim 18, further comprising:

forming a third plurality of cutting elements, each cutting element of the third plurality comprising the discontinuous phase dispersed within the continuous matrix phase; and securing the third plurality of cutting elements within cutting element pockets of the plurality of cutting element pockets.

* * * * *